United States Patent [19]

Budlong

[11] 4,034,424

[45] July 12, 1977

[54] AUXILIARY BATHTUB FOR INVALIDS

[76] Inventor: John E. Budlong, 9308 26th Place NW., Seattle, Wash. 98117

[21] Appl. No.: 627,947

[22] Filed: Nov. 3, 1975

[51] Int. Cl.[2] ..... A47K 3/00; A47K 3/06

[52] U.S. Cl. ..... 4/173 R; 4/177 R

[58] Field of Search ..... 4/173, 177, 176, 178, 4/185 R, 174, 175; 5/90, 60, 62, 98

[56] References Cited

U.S. PATENT DOCUMENTS

| | | | |
|---|---|---|---|
| 1,962,076 | 6/1934 | Jadkowski | 4/173 |
| 2,167,795 | 8/1939 | Bentz | 4/185 R |
| 2,576,623 | 11/1951 | McLaughlin | 4/176 |
| 2,710,976 | 6/1935 | Martensen | 5/98 |
| 3,423,767 | 1/1969 | Crook | 4/172.12 |
| 3,534,412 | 10/1970 | Crook | 4/172.12 |
| 3,585,660 | 6/1971 | Gottfried et al. | 5/60 |
| 3,800,336 | 4/1974 | Hoxeng | 4/177 |
| 3,800,342 | 4/1974 | Tenteris | 5/60 X |
| 3,803,642 | 4/1974 | Erling et al. | 4/177 |

FOREIGN PATENT DOCUMENTS

| | | | |
|---|---|---|---|
| 22,624 | 12/1891 | United Kingdom | 4/173 |

*Primary Examiner*—Henry K. Artis

[57] ABSTRACT

An auxiliary bathtub mounted above a conventional bathtub for use by invalids. The bathtub includes a rectangular frame approximating the shape of the conventional bathtub formed by a pair of parallel end walls and side walls. A flexible, waterproof liner extends between the side and end walls and along the inside faces thereof to form a watertight container. At least one of the side walls pivots downwardly to allow entry and exit from the tub. The pivoting side wall is held in its upright position by a releasable latching mechanism actuated through a release cord extending along the outside face of the side wall. A planar seat extends across one end of the tub beneath the liner to support the bather.

10 Claims, 6 Drawing Figures

FIG. 3
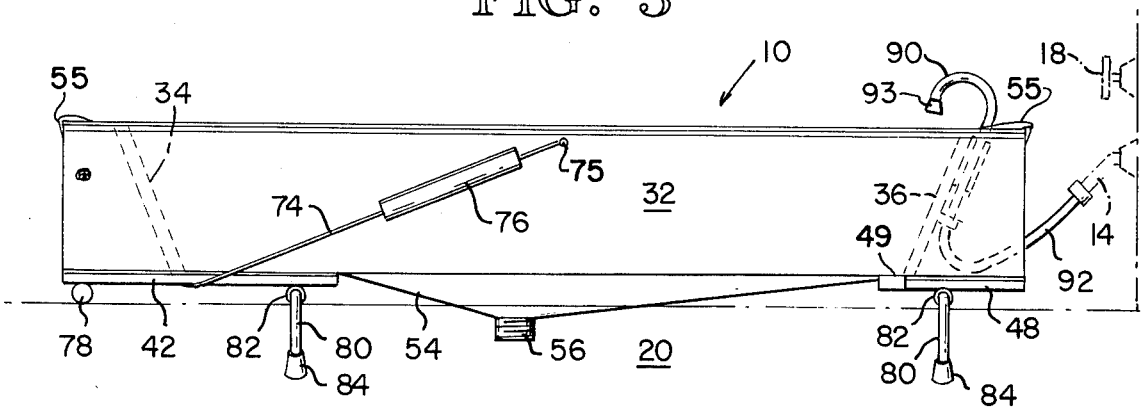
FIG. 4
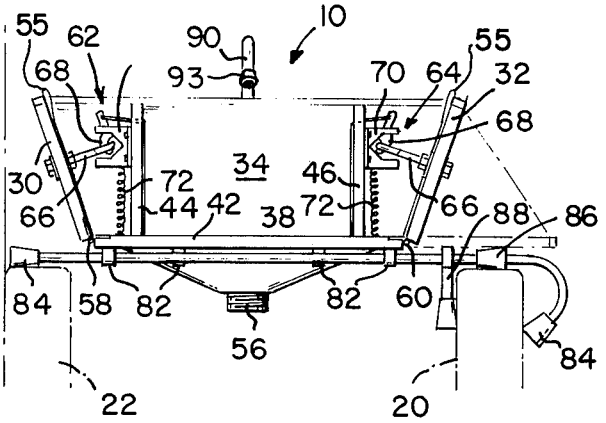
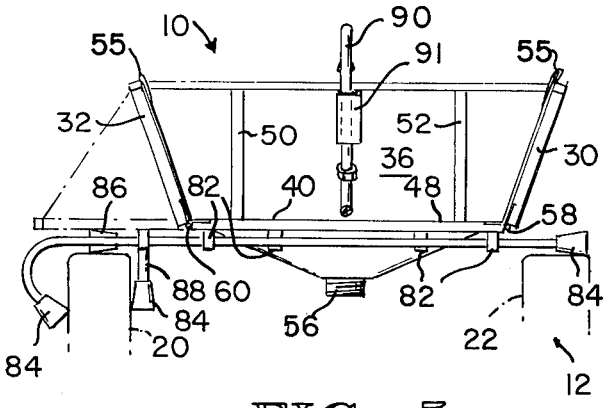
FIG. 5
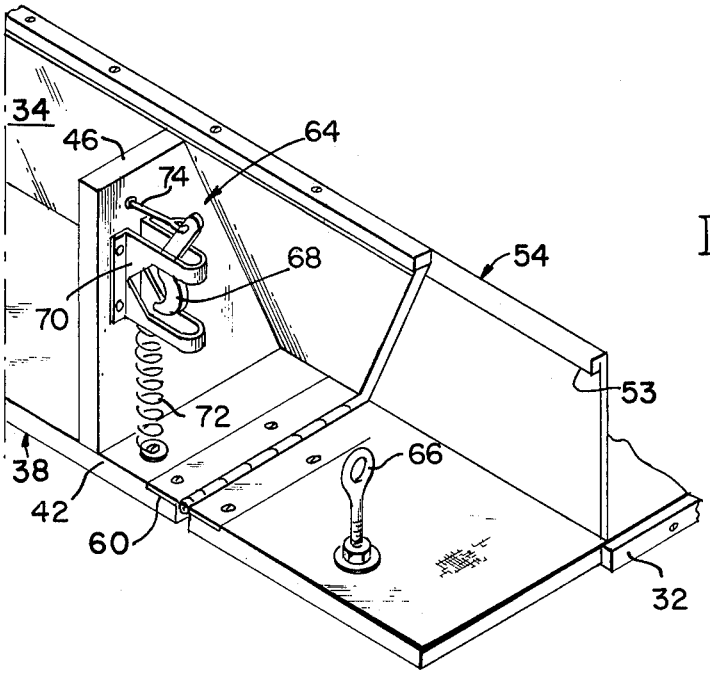
FIG. 6

AUXILIARY BATHTUB FOR INVALIDS

BACKGROUND OF THE INVENTION

1. Field of the Invention

This invention relates to an auxiliary bathtub for invalids and, more particularly, to an auxiliary bathtub having a bottom surface approximately flush with the top edges of the conventional bathtub and a side wall which may be lowered to facilitate entry and exit from the bathtub.

2. Description of the Prior Art

The bathing of handicapped, elderly, and convalescing people has always been somewhat of a problem. Although specialized bathing devices are well known and in common use for bathing such invalids, they are expensive and bulky, and therefore, generally not suitable for use in the home.

Conventional bathtubs may be used by invalids only with great difficulty since these individuals are usually not strong enough to gently lower themselves to the bottom of the tub and to subsequently raise themselves out of the tub at the conclusion of the bath. Therefore, invalids are able to bathe in the home only with the assistance of someone else having sufficient strength to lower them to the bottom of the bathtub.

Although commerical lifting devices have been developed for lowering and raising invalids into and out of a conventional bathtub, these devices are expensive, heavy, and too bulky to store easily.

SUMMARY OF THE INVENTION

It is an object of the invention to provide an auxiliary bathtub which may be used by invalids without assistance.

It is another object of the invention to provide an auxiliary bathtub which the bather may enter and exit without lowering himself into or lifting himself out of the bathtub.

It is still another object of the invention to provide an auxiliary bathtub which is relatively inexpensive and easy to store.

It is a further object of the invention to provide an auxiliary bathtub which may be easily installed on a wide variety of conventional bathtubs.

These and other objects of the invention are accomplished by an auxiliary bathtub having a rigid rectangular frame approximating the shape of the conventional bathtub and formed by a pair of end walls and a pair of side walls. The bottom of the auxiliary bathtub rests on the top edge of the conventional bathtub such that a planar seat extending across the bottom of the auxiliary bathtub is approximatley flush with the top edges of the conventional bathtub. The frame encloses a flexible waterproof liner which extends along the inside faces of the end and side walls. At least one of the side walls may be pivoted downwardly to a horizontal position to allow the bather to sit on its inside face and slide himself onto the seat before raising the side wall to its upright position and filling the bathtub with water. At the end of the bath, the auxiliary bathtub is emptied of water, and the pivotally mounted side wall is lowered to its horizontal positon to allow the bather to slide off the seat and onto the inside face of the side wall.

The auxiliary bathtub may be stored by supporting one end of the auxiliary bathtub at one end of the conventional bathtub and supporting the auxiliary bathtub in a vertical plane.

BRIEF DESCRIPTION OF THE DRAWINGS

FIG. 3 is a side elevational view of the auxiliary bathtub installed on a conventional bathtub.

FIG. 4 is a seat end elevational view of the auxiliary bathtub installed on a conventional bathtub showing a side wall in its lowered position in phantom.

FIG. 5 is a foot end elevational view of the auxiliary bathtub installed on a conventional bathtub showing a side wall in its lowered position in phantom.

FIG. 6 is a detailed isometric view of the releasable latching mechanism used to maintain the pivotally mounted side wall in its upright position.

DETAILED DESCRIPTION OF THE INVENTION

Figure 1:
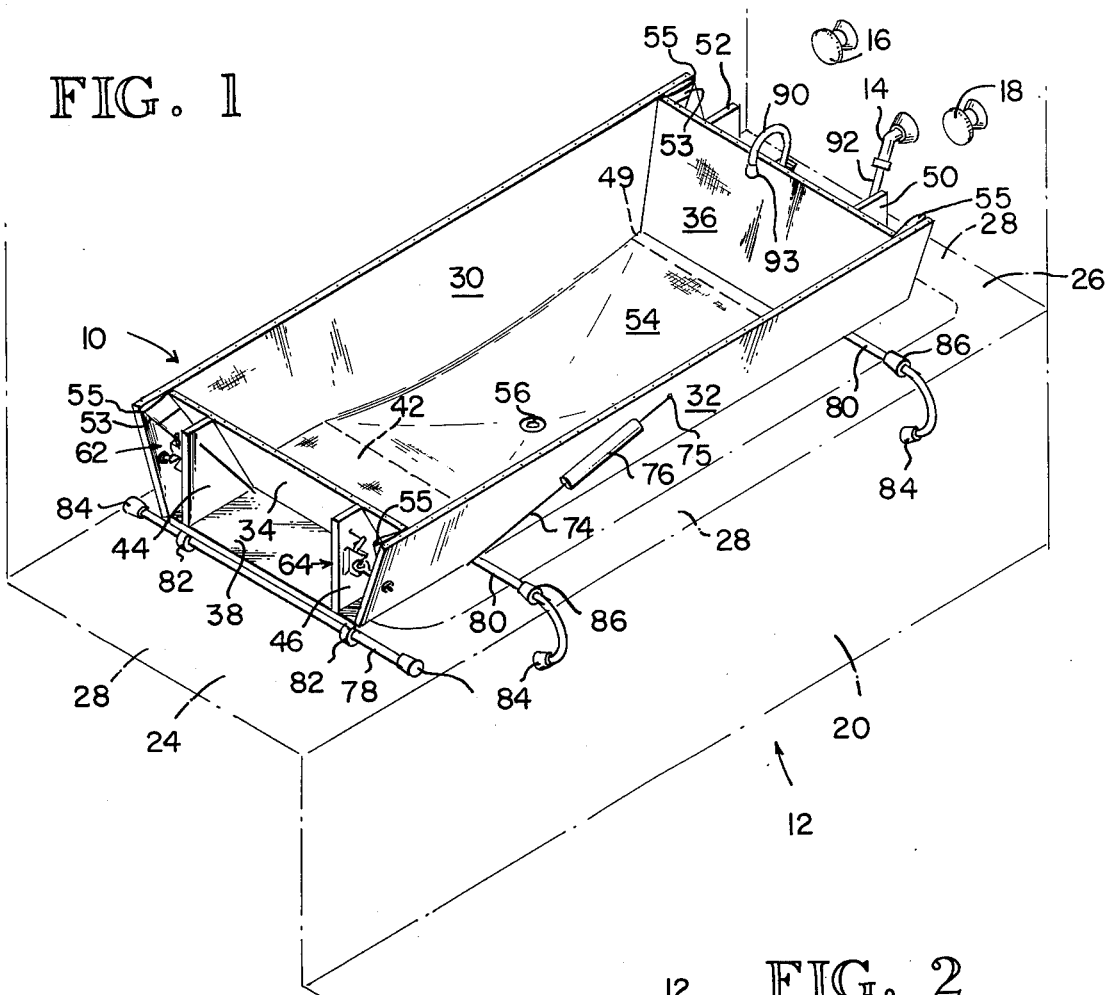
FIG. 1 is an isometric view showing the auxiliary bathtub installed on a conventional bathtub.

As illustrated in the drawings, the auxiliary bathtub 10 is installed on a conventional bathtub 12 to which water is supplied through a spout 14 as controlled by hot and cold water valves 16, 18 respectively. The conventional bathtub 12 includes an outer side wall 20, an inner side wall 22, and a pair of end walls 24, 26. The side and end walls 20, 22, 24, 26 extend upwardly from the bottom of the tub and terminate in a flat rim 28 which extends around the periphery of the tub.

The auxiliary bathtub includes a pair of planar side walls 30, 32 and a pair of end walls 34, 36. The side walls 30, 32 and end walls 34, 36 are held in position by a pair of end frames 38, 40. The end frame 38 is formed by a planar horizontal cross member 42, which extends along the width of the tub 10 which is large enough to form a seat 42, and a pair of trapezoidal support pieces 44, 46 which support the end wall 34. The end frame 40 is similarly constructed having a planar horizontal cross member 48 is not extended to form a seat or another direct firm support for a bathers body, except for a small foot rest 49, (FIGS. 2,3, and 5) and a pair of trapezoidal support pieces 50, 52 supporting the end wall 36. A continuous one piece flexible liner of waterproof material 54 extends between the side walls 30, 32 and end walls 34, 36 and along the inside faces thereof to form a watertight container. A drain port 56 is provided through the liner 54 to empty the auxiliary bathtub of water. During the bath the drain port 56 is covered by a stopper (not shown) to maintain the water level in the bathtub. At each corner of the auxiliary bathtub, the continuous one piece liner 54 has extra material with folded over sewed edge 53 to temporarily form a loop or fold 55 upon raising or pivoting the respective side wall 30 or 32. As will be explained hereinafter, these folds 55 allow the side walls 30, 32 to be lowered to a horizontal position, while maintaining liner 54 in its one continuous piece for its subsequent water tight integrity, thereby avoiding the need for creating a separable water tight joint.

Figure 2:
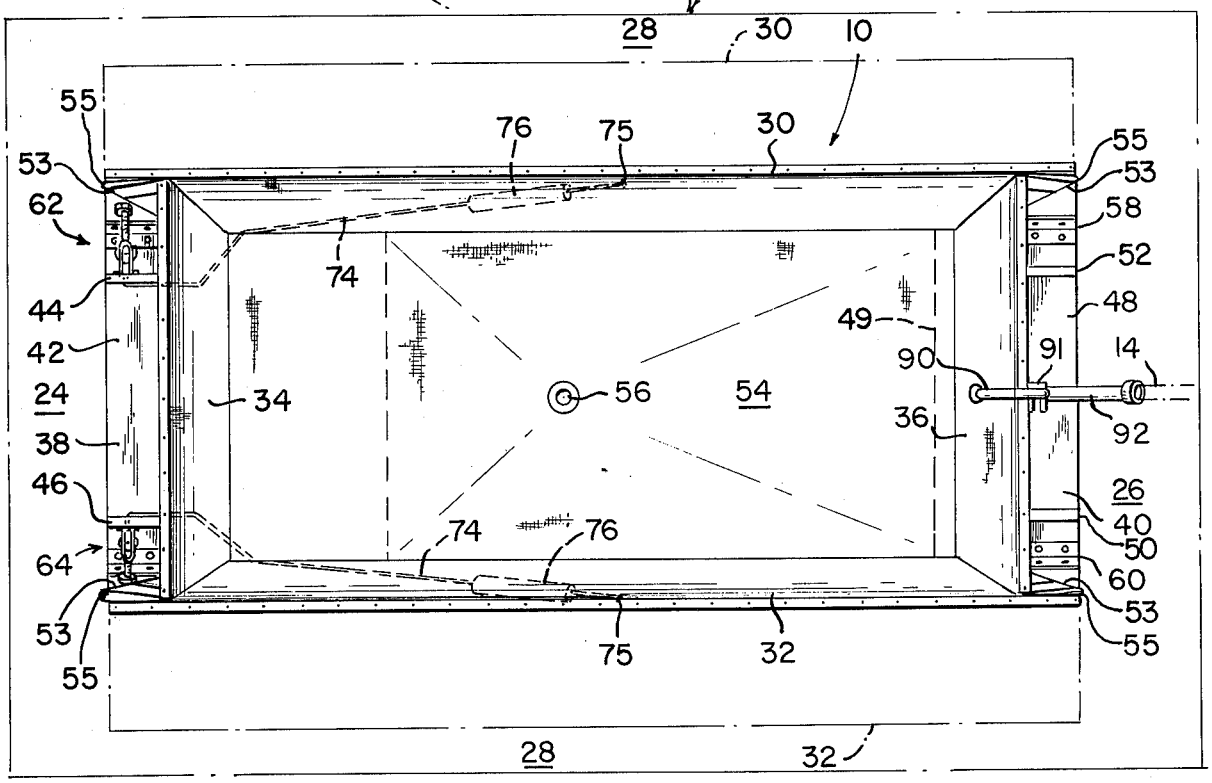
FIG. 2 is a top plan view of the auxiliary bathtub.

As best illustrated in FIGS. 4 and 5, the side walls 30, 32 are secured to the end frames 38, 40 by hinges 58, 60 which allow the side walls 30, 32 to pivot on a longitudinal axis with respect to the end frames 38, 40. The side walls 30, 32 are maintained in their upright position by releasable latching mechanisms 62, 64 illustrated in further detail in FIG. 6. Each of the latching mechanisms 62, 64 include a latching eye 66 secured to one of the side walls 30, 32. When the side walls 30, 32 are in their upright position, the eyes 66 are engaged by hooks 68 which are pivotally mounted in brackets 70 which are in turn secured to support pieces 44, 46. The hooks 68 are biased in their latching position by springs 72 which extend downwardly to the seat 42. The hooks 68 are pivoted to their eye releasing position by pivoting the end of the hooks 68 toward the support pieces 44, 46 by pulling on release lines 74 which, as illustrated in FIGS. 1, 2, and 3, extend along the outer faces of the side walls 30, 32 and terminate near the midpoint thereof and are secured by fasteners 75. The release lines 74 are surrounded at one point by release handles 76, which are firmly secured to lines 74, and which the bather grasps and pulls towards him to move the release lines 74, and thereby to pivot the hook 68 to its eye releasing position, thereby also allowing one of the respective selected side walls 30, 32 to be lowered.

The auxiliary bathtub is supported on the conventional bathtub by a rotatably mounted shaft serving as an overall roller 78 and a pair of support bars 80 all of which are secured to the underside of either seat 42 or cross piece 48 by metal brackets 82. The inner ends of the support bars 80 are straight while the opposite ends of the support bars 80 are bent downwardly to contact the outside face of the conventional tub side wall 20. Both ends of the bars 80 and roller 78 are covered with rubber caps 84 to avoid marring the surface of the conventional bathtub. Rubber bumpers 86 which are similar to the rubber caps 84 are placed on each bar 80 adjacent the curved end at the point where the bar rests on the rim of the side wall 20. The lateral position of the auxiliary bathtub with respect to the conventional bathtub is fixed by clamp bars 88 (FIGS. 4 and 5) which are slidably secured to their respective support bars 80. Means are provided for fixing the position of the clamp bars 88 with respect to the support bars 80, such as a conventional thumb screw, so that the rubber caps 84 at the end of the clamp bars 88 abut the inside face of the side wall 20. Also the roller 78 may have a lateral positioning flange, not shown, to aid in positioning the auxiliary bathtub 10 during its pivoting to a storage position.

Water is delivered to the auxiliary bathtub through a supply spout 90 which is mounted on the outside face of the foot end wall 36 by a bracket 91. A rubber tip 93 secured to the end of the spout 90 accommodates the hose end of a rubber shower unit (not shown) to allow a bather the option of using a hand shower. The other end of the spout 90 is connected to the conventional bathtub spout 14 through a flexible hose 92.

The auxiliary bathtub 10 may be stored against a wall adjacent the seat end of the bathtub by lifting the foot end while simultaneously rolling the bathtub on roller 78 along the rim 28 of the conventional bathtub so that the top edge of the auxiliary bathtub abuts a wall at the end of the conventional bathtub. Means are then provided, such as a hook (not shown), for maintaining the auxiliary bathtub in an upright position for storage. The conventional bathtub may then be used without interference from the auxiliary bathtub.

In operation the auxiliary bathtub is lowered to its in use position with the roller 78 and support bars 80 contacting the rim 28 of the conventional bathtub and the clamp bars 88 abutting the inside face of the outer side wall 20. The release handle 76 adjacent to the outer side wall 20 is then actuated by the bather to release the latching mechanism 64 thereby allowing the side wall 32 to be pivoted downwardly to a horizontal position with the side wall 32 resting on the rubber bumpers 86 as best seen in FIG. 4. The bather then sits on the inside face of the lowered side wall 32 and slides onto the seat 42 which is at the same level. He then reaches to the side and pivots the side wall 32 to its upright position, and this position is maintained by the releasable latching mechanism 64, which automatically latches and so remains, until intentionally released upon movement of the release handle 76. Water is then delivered to the tub through spout 90 and hose 92 which is connected to spout 14. When the bath is finished, a plug (not shown) is removed from the drain port 56 to drain the water from the bathtub. When the tub has been emptied of water, the bather actuates the releasable latching mechanism 64 by grasping the release handle 76 thereby lowering the side wall 32. Finally, the bather slides from the seat 42 onto the inside face of the side wall 32, staying at the same level, until he or she leaves the full seating support provided by this side wall. Then the bather, or a person assisting him or her, returns the side wall 32 to its upright position, using roller 78 and places the auxiliary bathtub in its upright storage at the end of the conventional bathtub 12 position.

The embodiments of the invention in which a particular property or privilege is claimed are defined as follows:

1. An auxiliary bathtub for horizontal placement to be used on the top of a conventional bathtub and for vertical placement during temporary non use at the end of the conventional bathtub opposite the faucet end, and for convenient manipulation between such placements, utilizing rolling and pivoting movement, and for convenient filling and draining by using the faucets and drain of the conventional bathtub, thereby providing an invalid with an opportunity of bathing at a level of the top of the conventional bath and essentially near a normal sitting level in a regular bathroom facility, comprising:

a. a frame for receiving upright walls which in turn define a bathing volume and for placement over a conventional bathtub, b. upright end walls defining the ends of the bathing volume, each end wall being secured to the frame c. upright side walls defining the sides of a bathing volume, each side wall being secured to the frame, and at least one side wall being pivotally secured for movement to a horizontal position substantially in the plane of the frame;

d. a seat secured to the frame and positioned adjacent one end wall substantially in the plane of the frame; and e. a flexible, continuous, and watertight, liner defining a bathing volume draped over the seat, ends walls and side walls, having sufficient material to accommodate the pivoting of one side wall to the horizontal position substantially in the plane of the frame and the seat when then the side wall becomes an extension of the seat for an invalid to use in getting to the coplanar seat, the liner being secured at its top to the tops of the end walls and side walls.

2. An auxiliary bathtub for horizontal placement to be used on the top of a conventional bathtub, as claimed in claim 1, comprising, in addition, a fastening subassembly with portions thereof mounted on both the frame and the pivotal side wall, whereby upon pivoting the side wall to its upright position, the fastening subassembly automatically secures the side wall in place, and whereby, upon a movement of hand of the invalid bather alongside the pivotal upright side, the fastening subassembly is released by the invalid, resulting in the pivotal upright side then pivoting to a horizontal position, where it becomes an extension of the seat for the invalids use in getting out of the auxiliary bathtub.

3. An auxiliary bathtub for horizontal placement to be used on the top of a conventional bathtub, as claimed in claim 2, comprising, in addition, a drain subassemly for securement to the flexible, continuous, and watertight liner at a place removed from the seat, where the liner is not directly supported, except at the top of the side walls, and therefore the liner depends below the seat level at this drain location, facilitating the draining of the auxiliary bathtub, and also during the invalid's bathing providing a more comfortable flexible support for his or her legs and feet in somewhat deeper water.

4. An auxiliary bathtub for horizontal placement to be used on the top of a conventional bathtub, as claimed in claim 3, comprising, in addition, hoses and fittings, whereby the water available at the conventional bathtub, upon operating the conventional bathtub faucets, is delivered to the bathing volume defined by the liner supported by the end walls and side walls of the auxiliary bathtub.

5. An auxiliary bathtub for horizontal placement to be used on the top of a conventional bathtub and for vertical placement during temporary non use at the end of the conventional bathtub opposite the faucet end, and for convenient manipulation between such placements, utilizing rolling and pivoting movements, and for convenient filling and draining by using the faucets and drain of the conventional bathtub, thereby providing an invalid with an opportunity of bathting at a level of the top of the conventional bathtub and essentialy near a nomal sitting level in a regular bathroom facility, comprising:

a. a frame for receiving upright walls which in turn define a bathing volume and for placement over a conventional bathtub;

b. upright end walls defining the ends of a bathing volume, each end wall being secured to the frame;

c. upright side walls defining the sides of a bathing volume, each side wall being secured to the frame, and at least one side wall being pivotally secured for movement to a horizontal position substantially in the plane of the frame;

d. a seat secured to the frame and positioned adjacent one end wall substantially in the plane of the frame;

e. a flexible, continuous, and watertight, liner defining a bathing volume draped over the seat, end walls, and side walls, having sufficient material to accommodate the pivoting of one side wall to the horizontal position substantially in the plane of the frame and the seat when then the side wall becomes an extension of the seat for an invalid to use in getting to the coplanar seat, the liner being secured at its top to the tops of the end walls and side walls;

f. a fastening subassembly with portions thereof mounted on both the frame and the pivotal side wall, whereby upon pivoting the side wall to its upright position, the fastening subassembly automatically secures the side wall in place, and whereby, upon a movement of hand of the invalid bather alongside the pivotal upright side, the fastening subassembly is released by the invalid, resulting in the pivotal upright side then pivoting to a horizontal position, where it becomes an extension of the seat for the invalids use in getting out of the auxiliary bathtub;

g. a drain subassembly for securement to the flexible, continuous, and watertight liner at a place removed from the seat, where the liner is not directly supported, except at the top of the side walls, and therefore the liner depends below the seat level at this drain location, facilitating the draining of the auxiliary bathtub, and also during the invalid's bathing providing a more comfortable flexible support for his or her legs and feet in somewhat deeper water; and h. hoses and fittings, whereby the water available to the conventional bathtub, upon operating the conventional bathtub faucets, is delivered to the bathing volume defined by the liner supported by the end walls and side walls of the auxiliary bathtub.

6. An auxiliary bathtub for horizontal placement to be used on the top of a conventional bathtub, as claimed in claim 5, comprising, in addition, a lateral roller rotatably secured to the frame at the seat end of the auxiliary bathtub, whereby this bathtub is conveniently rolled to and from the facuet end of the conventional bathtub and also this bathtub is conveniently pivoted upwardly to a vertical non use position on the conventional bathtub at the end opposite the facuet and, clearing the access to the conventional bathtub.

7. An auxiliary bathtub for horizontal placement to be used on the top of a conventional bathtub, as claimed in claim 5, comprising, in addition, a pair of parallel and spaced laterally directed positioning subassemblies secured to the frame and each having depending paired positioners of adjustable spacing to fit snugly on the respecitve outer and inner sides of the side wall of a conventional bathtub, whereby the auxiliary bathtub is firmly positioned laterally in its horizontal use position on the conventional bathtub.

8. A auxiliary bathtub for horizontal placement to be used on the top of a conventional bathtub, as claimed in claim 6, comprising, in addition, a pair of parallel and spaced laterally directed positioning subassemblies secured to the frame and each having depending paired positioners of adjustable spacing to fit snugly on the respective outer and inner sides of the side wall of a conventional bathtub, whereby the auxiliary bathtub is firmly positioned laterally in its horizontal use position on the conventional bathtub.

9. An auxiliary bathtub for horizontal placement to be used on the top of a conventional bathtub, as claimed in claim 8, wherein the frame is composed of two portions longitudinally spaced, one portion of a smaller longitudinal length positioned at the faucet end of the auxiliary bathtub, and the other portion of a longer longitudinal length to also provide the invalid seating space, and upon the securement of the side walls these two frame portions become permanently spaced apart and define an overall frame for the auxiliary bathtub.

10. An auxiliary bathtub for horizontal placement to be used on the top of a conventional bathtub, as claimed in claim 9, wherein both of the side walls are pivotally secured to be lowered to a horizontal position, and the liner is provided with sufficient material to reach a completely planar configuration when both of the side walls are lowered to their horizontal positions, thereby making the auxiliary bathtub easily cleaned in this planar configuration, and also making the auxiliary bathtub useful in various bathrooms where the access to the conventional bathtub may be from respective opposite longitudinal sides.

* * * * *